United States Patent [19]

Muramatsu et al.

[11] Patent Number: 4,513,652

[45] Date of Patent: Apr. 30, 1985

[54] SOLENOID ACTUATOR FOR USE IN AUTOMATIC PERFORMANCE PIANO

[75] Inventors: Shigeru Muramatsu, Shizuoka; Yuji Fujiwara, Hamamatsu; Hazime Hayashida, Hamamatsu; Jun Yamamoto, Hamamatsu, all of Japan

[73] Assignee: Nippon Gakki Seizo Kabushiki Kaisha, Shizuoka, Japan

[21] Appl. No.: 409,071

[22] Filed: Aug. 18, 1982

[30] Foreign Application Priority Data

Sep. 8, 1981 [JP] Japan ..... 56-132551[U]
Sep. 8, 1981 [JP] Japan ..... 56-132552[U]
Sep. 8, 1981 [JP] Japan ..... 56-132553[U]

[51] Int. Cl.[3] ..... G10F 1/02; G10F 3/00; G10C 3/20

[52] U.S. Cl. ..... 84/20; 84/107; 84/246

[58] Field of Search ..... 84/20, 107, 246; 335/255, 262

[56] References Cited

U.S. PATENT DOCUMENTS 3,088,360 5/1963 Hayden ..... 84/246
3,126,782 3/1964 Fauser ..... 84/246
3,160,052 12/1964 Gunter ..... 84/107
3,426,304 2/1969 Cannon et al. ..... 335/255
3,581,254 5/1971 Cannon et al. ..... 84/107
3,634,877 1/1972 Cannon et al. ..... 84/107
4,031,796 6/1977 Wilkes ..... 84/20
4,121,496 10/1978 Wilkes ..... 84/20
4,338,847 7/1982 Brennan et al. ..... 84/20
6,031,796 6/1977 Wilkes ..... 84/20

FOREIGN PATENT DOCUMENTS 705623 3/1965 Canada ..... 84/20

*Primary Examiner*—L. T. Hix
*Assistant Examiner*—Douglas S. Lee
*Attorney, Agent, or Firm*—Blakely, Sokoloff, Taylor & Zafman

[57] ABSTRACT

In a solenoid actuator for use in an automatic performance keyboard instrument of the type comprising a key bed and a plurality of keys mounted on the key bed through seesaw mechanisms, electromagnetic actuators respectively corresponding to the keys and having a common yoke are disposed between the key bed and the keys. Each of the electromagnetic actuators independently actuates the corresponding key. The yoke and the electromagnetic actuators are assembled into a compact unit, thereby being readily incorporated between the key bed and the keys.

10 Claims, 5 Drawing Figures

SOLENOID ACTUATOR FOR USE IN AUTOMATIC PERFORMANCE PIANO

BACKGROUND OF THE INVENTION

This invention relates to a solenoid actuator utilized in a musical instrument having a keyboard.

Such solenoid actuators are used as actuators of an automatic performance piano, for example. Examples of such application are disclosed in U.S. Pat. Nos. 3,426,304 and 4,031,796.

The solenoid actuator disclosed in these patents is in the form of a well known electromagnetic plunger comprising an electromagnetic coil, a movable core or plunger slidably received in the electromagnetic coil, and a magnetic yoke for forming a flux path. A plurality of solenoid actuators are driven by electrical signals formed by reproducing prestored signals so as to operate the keys of the keyboard as if they were depressed by hands.

Generally, a conventional piano is designed to have an ample space to accommodate the actuators for the automatic performance at accurate positions but not designed to compactly incorporate the solenoid actuators in the space. Accordingly, to incorporate the solenoid actuators for effecting automatic performance, the construction becomes complicate and expensive and the size becomes large.

SUMMARY OF THE INVENTION

Accordingly, it is the principal object of this invention to provide an improved solenoid actuator for use in a musical keyboard which is compact in construction and can readily be accommodated in a narrow space.

Another object of this invention is to provide a solenoid actuator for use in a musical keyboard having a unit construction and can be simply assembled.

Still another object of this invention is to provide a solenoid actuator for use in a musical keyboard capable of increasing a thrust force generated by the solenoid actuator.

Briefly stated, according to this invention these objects can be accomplished by disposing electromagnetic switches for actuating a plurality of keys mounted on a key bed through seesaw mechanisms.

According to this invention, there is provided a solenoid actuator for use in a musical keyboard of the type comprising a key bed and a plurality of keys mounted on the key bed through seesaw mechanisms, characterized in that a plurality of electromagnetic actuators are disposed between the key bed and the keys for independently actuating the keys.

DESCRIPTION OF THE PREFERRED EMBODIMENTS

Figure 1:
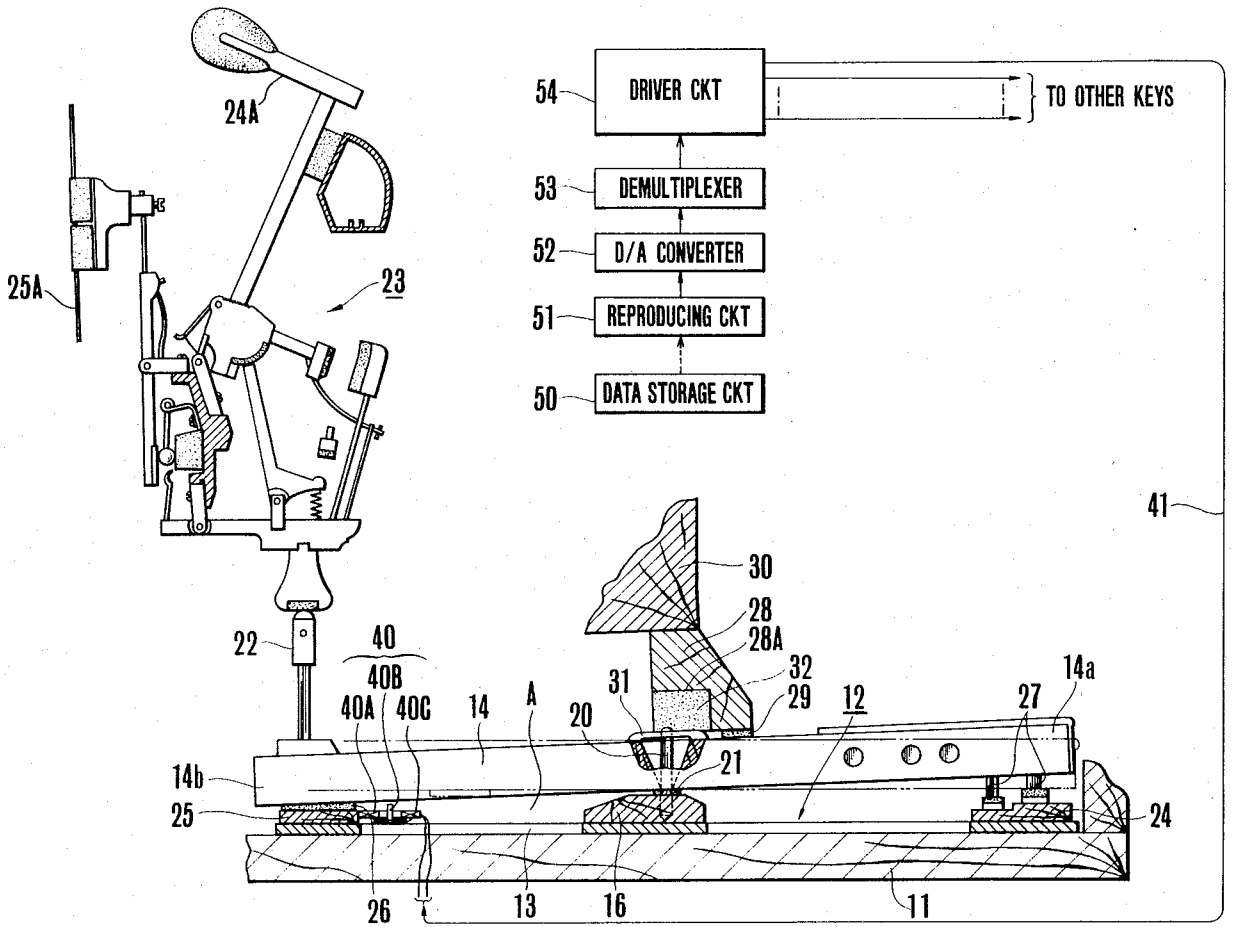
FIG. 1 is a view, partly in section and in a block form, showing the basic construction of a key switch structure for the automatic performance of a keyboard instrument and automatic performance apparatus.

A switch structure for the automatic performance of a keyboard instrument embodying the invention and shown in FIG. 1 is especially suitable for a piano. As shown, a key frame 13 is mounted on the upper surface of a key bed 11 and keys 14 are mounted on the key frame 13 to be tiltable downwardly about their longitudinal centers. The central portion of each key is supported by a balance pin 20 provided on a balance rail 16. More particularly, the central portion of each key 14 is mounted on a felt layer 21 so that when its front end **14*a* is depressed the key rotates or tilts in the vertical direction about an opening through which the pin 20 extends to raise its ear end 14*b*. Then a string 25A is struck by a hammer 24A through a capstan button 22 and a well known action mechanism 23 connected thereto, thus producing a tone. The rear end 14*b* of each key is mounted on a back rail 25 through a felt layer 26 oval key pins 27 are secured to the upper surface of the front rail 24** to limit the vertical rotation of the keys.

A key stop rail 28 is positioned above the keys at position slightly before the central portion of the keys, that is at positions where the keys are fitted with the pins so as to engage all keys through a felt layer 29. The opposite ends of the key stop rail 28 are supported by arms (not shown) of the casing of the musical instrument. The surface of the key stop rail 28 is bonded to the layer surface of one side of a cover 30 of the keyboard. The purpose of the felt layer 29 is to limit the counterclockwise rotation of the keys 14 and to conceal from outside the key bottons 31, the balance pins 20, etc.

In this embodiment, a notch 28A is provided for the rear side of the key stop rail 28 to receive a clamping member 29 made of felt, for example, which prevents all keys from being raised at the time of the automatic performance to be described later.

The invention is characterized in that solenoid actuators also acting as key switches (hereinafter merely called key switches) are disposed in a space A between the rear ends **14*b* of the keys 14 and the key frame 13. Each key switch 40 is constituted by an electromagnetic coil 40A and a movable member or plunger 40B received in the central opening of the electromagnetic coil 40A. As is well known in the art, each electromagnetic coil 40A is formed by wrapping a conductor many times about a cylindrical bobbin having flanges on both sides and mounted above the key frame near the back rail 25 of the key frame 13. The upper end of each plunger is disposed to oppose the lower surface of the rear end 14*b* of the key, while the upper end is disposed to oppose the upper surface of the key frame 13. To the lower end of the plunger is attached a disc shaped magnetic member acting as an armature which forms a portion of the magnetic path for the magnetic flux generated by the electromagnetic coil 40A**.

Each electromagnetic coil 40A is supplied with an output of a driver circuit 54. The driver circuit 54 is connected to receive signals from a data storage circuit 50 via a reproducing circuit 51, a D/A converter 52, and a demultiplexer 53. The data storage circuit 50 is constituted by suitable recording medium such as a magnetic tape and a magnetic disc for storing data necessary to energize the solenoid actuators to effect an automatic performance.

To reproduce the data, the data stored in the data storage circuit 50 are converted into electric signals by the reproducing circuit 51, the electric signals are converted into analog signals by the digital-analog converter 52 and then converted into signals corresponding to respective keys by the demultiplexer 53. The demultiplexed signals are supplied to respective portions of the driver circuit 54 for driving electromagnetic coils 40A of the keys to be depressed. The data stored in the data storage circuits 54 contain various characteristics of a musical tone to be produced, for example, the note pitch, tone color, etc.

When an electromagnetic coil 40A is energized by the signal supplied from the driver circuit 54, its plunger 40B and armature 40C are raised to raise the rear end **14*b* of each key. At this time, the clamping member 32 prevents the keys from being raised. Raising the rear end 14*b* of the key is equivalent to press down its front end 14*a***.

With the construction of this invention described above, the following advantages can be obtained.

(1) Since the electromagnets and the plungers are disposed in a space between respective keys and the key bed the automatic performance apparatus can be assembled in a compact structure.

(2) Since each actuator is disposed in a space between respective keys and the key bed on the rear side of the balance pins 20 it is not necessary to subject the keys and key bed to any special machining work.. This permits ready incorporation of the solenoid actuators into commercial keyboard instruments. Furthermore, the adjustment of the solenoid actuators can be made relatively readily.

(3) Since the electromagnetic solenoid embodying the invention is constituted by an electromagnetic coil, a plunger and an armature integral therewith it is possible to produce a thrust force sufficient to raise the keys without the necessity of designing the coil, plunger and armature to have any special configuration.

Figure 2:
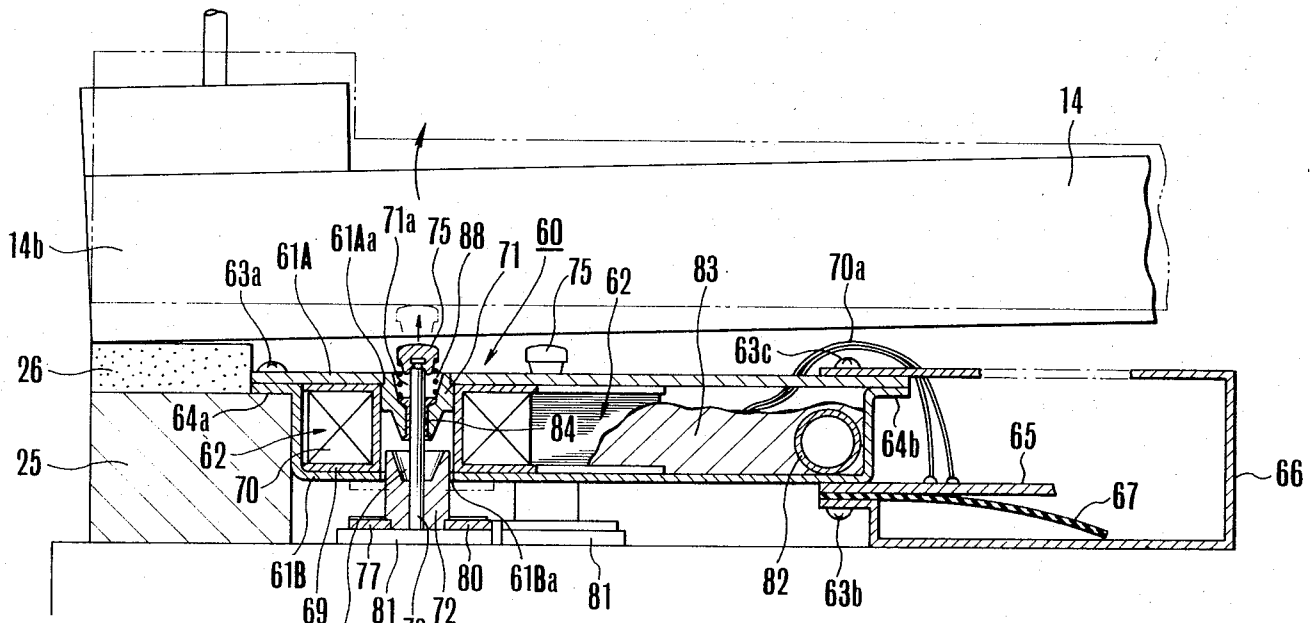
FIG. 2 is a side view, partly in section, showing another embodiment of a keyboard incorporated with a solenoid actuator according to this invention.
Figure 3:
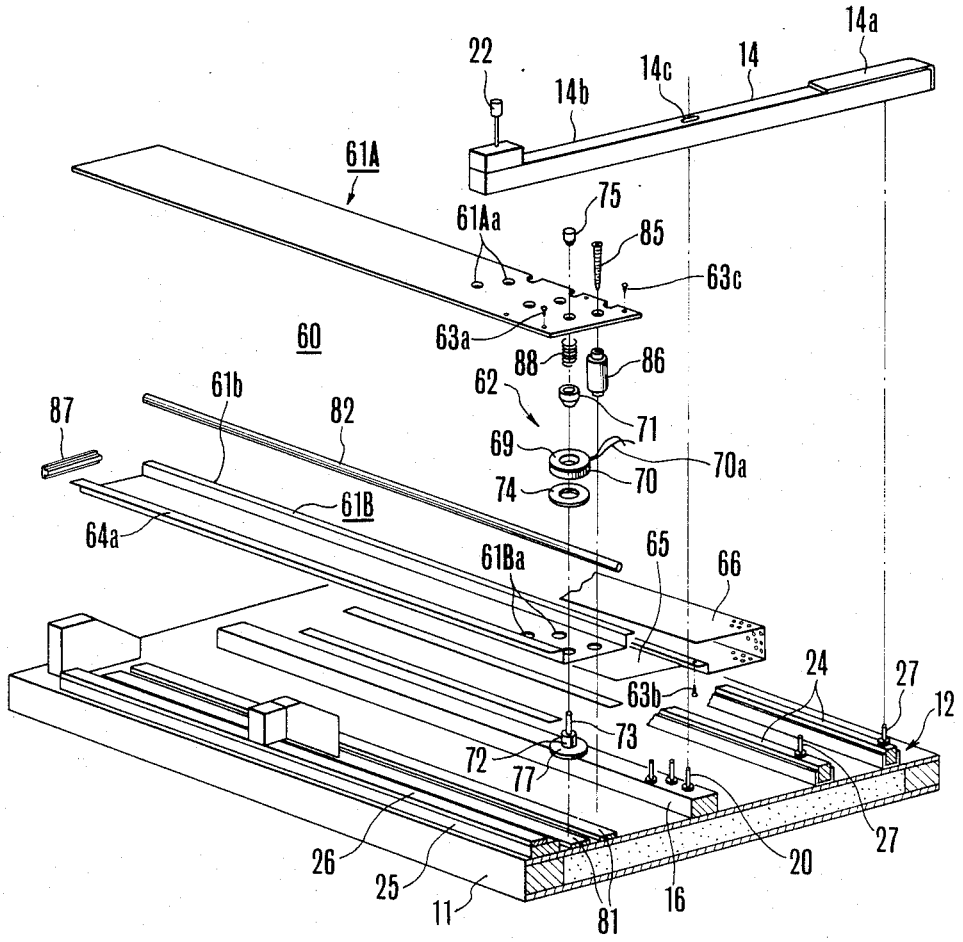
FIG. 3 is an exploded perspective view of the solenoid actuator shown in FIG. 2.

FIGS. 2 and 3 show another embodiment of this invention in which elements corresponding to those shown in FIG. 1 are designated by the same reference charactors. In these figures, the key frame assembly 12 comprising the front rail 24, the balance rail 16, and the rear rail 25 is mounted on the key bed 11, and on the key frame assembly 12 are mounted a member of keys 14 to be tiltable in the vertical direction about their central portions.

More particularly, each key is tiltably supported by inserting the balance pin 20 secured to the balance rail 16 into a funnel shaped perforation **14*c* formed at the central portion of the key. An action mechanism shown in FIG. 1 is connected to the rear end 14*b* of the key 14 through the capstan button 22. With this construction, in the normal or inoperative state, the front end 14*a* of each key is held above the front rail 24 while the rear end 14*b* rests on the back rail 25 via the felt layer 26. Oval front pins 27 are secured to the upper surface of the front rail 24**, the upper ends of the front pins being normally received in recesses (not shown) formed on the lower side of each key for limiting the longitudinal motion thereof.

In a space between the key frame assembly 12 and the keys 14, that is between the balance rail 16 and the back rail 25 are disposed a plurality of flat actuators 60 corresponding to respective keys. As shown in FIG. 2, each actuator 60 comprises a pair of upper and lower yoke members 61A and 61B extending in the direction of the key 14 and a plunger 62 disposed between the upper and lower yoke members 61A and 61B. The. actuators for respective keys are staggered. The yoke members 61A and 61B are made of magnetic material such as soft steel or the like to provide common flux path for respective electromagnetic coils. The lower yoke member 61B has a dish shape and the upper yoke member 60A is disposed to cover the opening of the lower yoke member 61B and secured thereto by set screws **63*a*. The upper ends of the side walls of the lower yoke member 61B are bent horizontally to form mounting members 64*a* and 64*b*. The mounting member 64*a* and the upper yoke member 61A are secured to the front end of the back rail 25 by screws 63*a*. The bottom of the front side of the lower yoke member 61B is supported by a shield casing 66 together with a printed substrate 65 including the drive circuit 64 and the circuitries associated therewith by screws 63*b*. The assembly thus formed is disposed above the key bed 11 with a predetermined spacing therebetween. The rear end of the printed substrate 65 is secured the front bottom surface of the lower yoke member through a sheet of insulating paper 67 so as to be electrically isolated from the lower yoke member 61B. The shield casing 66 is made of a thin perforated metal sheet and a sectional configuration of a letter U. The upper surface of the casing is secured to the front end of the upper yoke member 61A by screws 63*c* while the lower surface is secured to the bottom of the lower yoke member 61B by screws 63*b***.

The upper and lower yoke members 61A and 61B are formed with a plurality of staggered perforations **61A*a* and 61B*a* corresponding to respective actuators. Each actuator comprises a cylindrical bobbin 69 having flanges at both ends, a troidal exciting coil 70 wound about the bobbin 69, upper and lower yokes 71, 72 inserted into the upper and lower portions of the bobbin 69 and a pin 73 fitted in the inner opening of the lower yoke 72. More particularly, the upper and lower flanges of the bobbin 69 are secured to the lower surface of the upper yoke member 61A and the upper surface of the lower yoke member 61B by adhesive tapes 74 (FIG. 3). Lead wires 70*a* of the exciting coil 70 are lead out to the outside through a perforation, not shown, provided through the upper yoke member 61A and then led into the shield casing 66 to be connected to the terminals of the printed substrate 65. The upper yoke 71 is fitted into the upper opening of the cylindrical bobbin 69, and the upper end of the yoke 71 is fitted into a perforation 61A*a* of the upper yoke member 61A**.

The lower portion of the upper yoke 71 has a frust conical configuration and the upper portion is provided with a recess **71*a* for receiving a push up button 75 in the form of a rubber bushing threaded on the upper end of the pin 73**.

The lower yoke 72 is also cylindrical and its upper end is slidably received in the bobbin 69 through a perforation provided for the lower yoke member 61B. A magnetic flange or an armature 77 is secured to the lower yoke 72. The upper opening **72*a* of the lower yoke 72 is tapered to fit with the lower portion of the upper yoke 71. The pin 73 is made of a nonmagnetic material and its lower end is secured to the inner opening of the lower yoke 72 by force fit or calking, while the upper end slidably extends through an opening of the upper yoke 71 to project beyond the upper surface of the upper yoke member 61A. Consequently, the lower yoke 72, the armature 77 and the pin 73 are integrally combined to constitute a movable member which is attracted upwardly when the exciting coil 70 is excited by a signal current. A cushion member 80 made of felt or the like is mounted on the upper surface of the armature 77 as shown in FIG. 2. Normally, the armature 77 rests on a stripe shaped cushion member 81 made of felt or the like mounted on the key bed 11**.

A heat dissipating pipe 82 is contained in the lower yoke member 61B for the purpose of dissipating the heat generated by the exciting coil 70. The heat dissipating pipe 82 extends in the direction of the lower yoke member 61B, and the space between the heat dissipating pipe 82 and the exciting coil 70 is filled with a heat conductive material 83, for example an epoxy resin incorporated with a powder of metal or a heat conductive filler. If the heat dissipating pipe 82 were not provided the back rail and the felt would deform due to temperature rise.

In the above embodiment, the heat dissipating pipe 82 is replaced by a plurality of heat dissipating pipes 82 stacked in the vertical direction to increase the heat dissipating ability. Instead of pipe or pipes, the heat dissipation member may be made of a metal strip.

The provision of one or more heat dissipating pipes makes uniform the temperature distribution of the entire solenoid actuators, thus preventing decrease in the driving force of the actuators and hence improving the useful life.

A collar 84 is fitted into the opening of the yoke 71 to assist sliding of the pin 73. The collar 84 is made of such antiwearing material as a plastic, delline and teflon. The upper and lower yoke members 61A and 61B are secured to the key bed 11 by screws 85 and spacers 86, and the side opening of the yoke member 61B is closed by a side cap 87. A spring 88 is interposed between the push up button 75 and the bottom of the recess of the upper yoke 71 for the purpose of preventing decrease in the thrust force caused by the weight of the push up botton 75 when the solenoid actuator is operated.

In the actuator 60 described above, when a signal current is supplied to the exciting coil 70 of a solenoid actuator corresponding to a given key the lower yoke 72 is pulled upwardly by the magnetic flux created across the upper and lower yokes 71 and 72 so that the pin 73 integral with the lower yoke 72 is pulled upwardly to cause the push up button 75 to collide against the lower surface of the rear end **14*b* of the key 14. Accordingly, the key will tilt as if it were depressed by a finger. As the signal current is removed from the exciting coil 70, the pin 73 and the lower yoke 72 drop to the normal position shown in FIG. 2** by their own weights and the key too returns to the normal position.

Since the actuators 60 are disposed between the key bed 11 and the keys 14, it is not necessary to work the key bed 11 so that the mechanical strength thereof is not decreased. Furthermore, as a plurality of solenoid actuators corresponding to respective keys are contained between a pair of upper and lower yoke members 61A and 61B to form an integral unit, mounting of the unit on a piano keyboard is faciliated. Moreover, as the actuators are not seen from the outside of the body of the piano it does not impair the apperance, and since the pair of yoke members 61A and 61B form a common flux path for a plurality solenoid actuators 62, they not only decrease the reluctance but also increases heat dissipation together with the heat dissipating pipe 82, thus making uniform the temperature distribution caused by the heat generated by the electromagnetic coils. Accordingly, the driving forces of frequently used solenoid actuators would not be decreased due to the influence of heat, whereby the driving forces of the actuators can be maintained constant.

Figure 4:
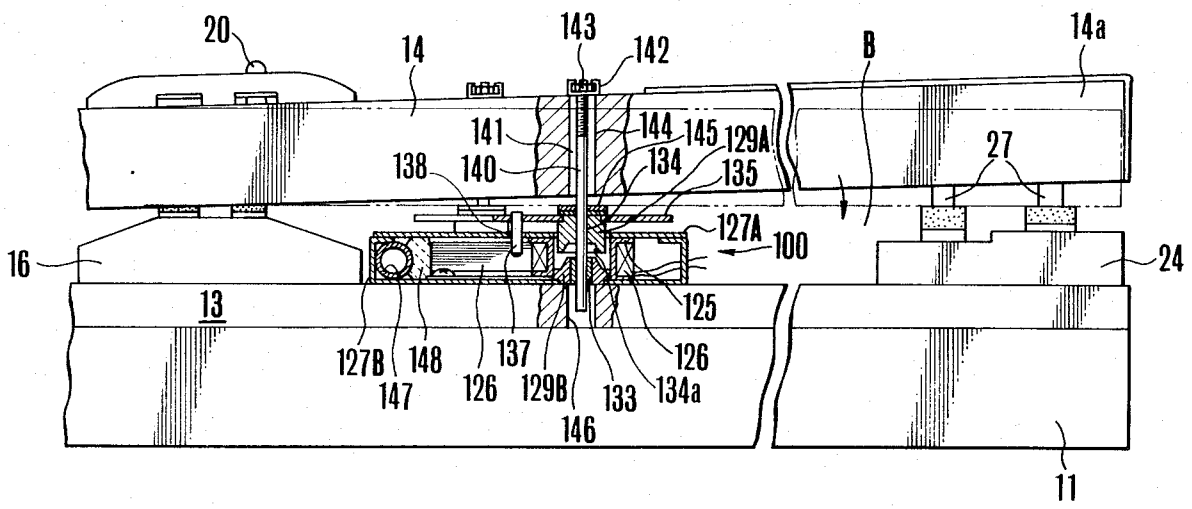
FIG. 4 is a side view, partly in section showing still another embodiment of a keyboard provided with the solenoid actuator according to this invention.
Figure 5:
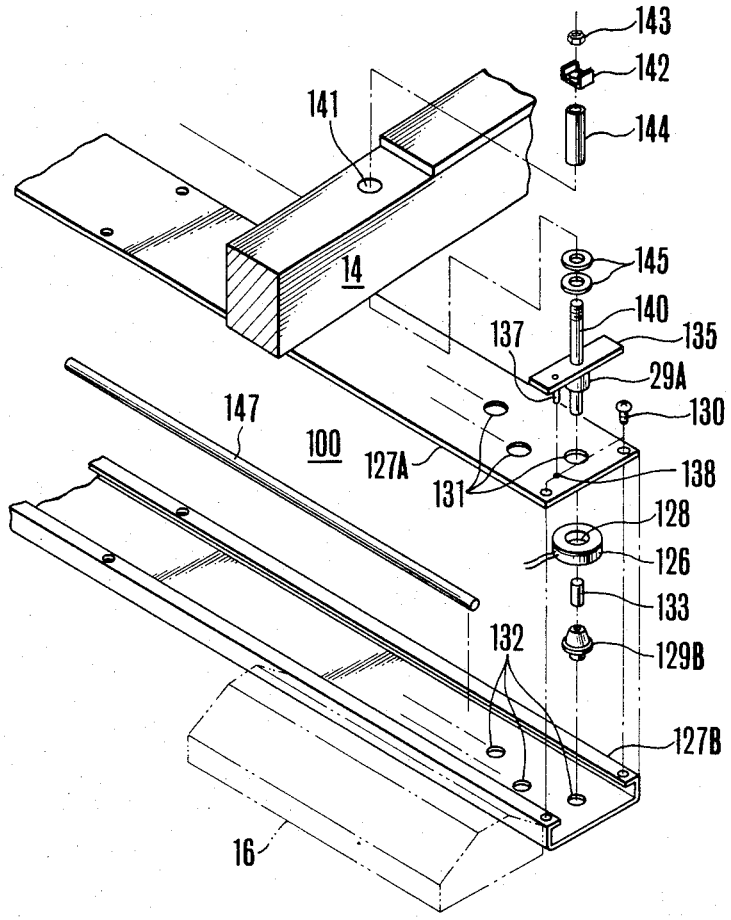
FIG. 5 is an exploded perspective view showing the solenoid actuator shown in FIG. 4.

FIGS. 4 and 5 illustrate still another embodiment of a solenoid actuator according to this invention. As shown, a key frame 13 is mounted on a key bed 11, and a plurality of keys are mounted on the key frame 13 so as to tilt in the vertical directions about their central portions.

More particularly, each key is tiltably supported by a balance pin 20 secured to a balance rail 16 and extending through an opening at an axial center of the key. An action mechanism shown in FIG. 1 is mounted on the left or rear end of the key through a capstan so that the front end of the key is normally maintained above the front rail 24. As before oval key pins 27 are provided to limit longitudinal movement of the key.

An actuator 100 is interposed in a space B between the bottom surface of the key 14 and the key frame 13. The actuator 100 comprises an electromagnetic plunger and four yokes, viz a pair of upper and lower yokes 127A and 127B (common to all actuators) for commonly containing a plurality of exciting coils 126 wound about flanged bobbins 125, and a pair of upper and lower cylindrical yokes 129A and 129B inserted into a central opening 128 of each exciting coil 126. The lower common yoke 127B secured adjacent to the balance rail 16 has a U shaped cross-sectional configuration and extends in parallel with the key 14. The flat plate shaped upper common yoke 127A is secured to the upper surface of the lower yoke 127B by set screws 130. A plurality of longitudinally spaced apart perforations 131 and 132 are formed corresponding to the cylindrical yokes 129A, 129B at the centers of the widths of the common yokes 127A and 127B. In other words, the perforations 131 and 132 are staggered in the direction of arrangement of the keys 14.

The upper cylindrical yoke 129A has the same outer diameter throughout its length and its lower opening is tapered or conical. The cylindrical yoke 129A is secured, as by calking to an armature 135 mounted on the common yoke 127A, and a pin 140 made of a nonmagnetic metal is force fitted into the inner opening 134 of the cylindrical yoke 129A. Accordingly, the cylindrical yoke 129A, the armature 135, and the pin 140 are integrally combined to form a movable member which is pulled down when a signal current is supplied to the exciting coil 126. The upper end of the lower cylindrical yoke 129B has a conical configuration so as to form a surface parallel with the conical opening **134*a* of the upper cylindrical yoke 129A. The both cylindrical yokes are normally spaced apart to form an air gap therebetween. The lower end of the lower cylindrical yoke 129B is fitted into the perforation 132 to be secured to the common yoke 127B and a guide bushing or a collar 133 is press fitted into the central opening of the lower yoke 129B**.

The armature 135 is provided with a depending pin 137 for preventing rotation thereof, the pin extending through a small opening 138 of the upper common yoke 127A. The lower end of the shaft 140 is slidably inserted through the inner opening of the lower cylindrical yoke 129B, while the upper end is hung by the key 14. To this end, a nut 143 is threaded on the projected end of the pin 140 through a rotation preventing fixture 142. As a consequence, by rotating the nut 143 it is possible to adjust the gap (that is the height of the pin 140) between the key 14 and the actuator 100. The diameter of the perforation 141 is sufficiently larger than the diameter of the pin 140 and a guide pipe 144 is fitted in the perforation 141. An annular cushion member 145 made of leather or felt is mounted on the armature 135 to surround the pin 140. The lower end of the pin 140 is received in a perforation of the key frame 13 when the key 14 is disposed on the key frame 13.

A heat dissipating pipe 147 is contained in the common yoke 127B to dissipate the heat generated by the exciting coil 126. The heat dissipating pipe 147 extends in parallel with the common yoke 127B and the spaces between the pipe 147 and a plurality of exciting coils 126 corresponding to respective keys are filled with heat conductive resin compound described above.

When a signal current is supplied to the exciting coil 126 corresponding to a given key, the movable member constituted by the upper cylindrical yoke 129A, the armature 135 and the pin 140 is pulled down by the flux produced across an air gap between the upper and lower cylindrical yokes 129A and 129B so as to rotate the key as if it were depressed by a finger. When the signal current disappears, the key 14 is restored to the original position by the weight of the action mechanism to pull up the movable member.

This modified actuator has the same advantages as the previous embodiments.

Since the upper end of the pin 140 is secured to the key by nut 143, the key and pin are moved in unison and the spacing between the key 14 and the actuator 100 can be adjusted by rotating the nut 143. Consequently, after assembling the actuator 100, the drive forces for respective keys can be readily adjusted from above the keys. Furthermore, since the actuators 100 pull down the front ends (performer's side) of the keys there is no fear of disengaging the keys from the balance pins 20 different from the construction shown in FIG. 1 in which the keys are raised by the actuators.

Although, in this modification the upper end of each pin 140 is directly connected to the upper surface of the key, it is also possible to provide a suitable connecting member for the pin 140 for connecting the upper end of the connecting member to the upper surface of the key. The perforation 146 provided for the key frame 13 may be omitted depending upon the length of the pin 140 or the arrangement of the actuator 100. Instead of mounting the actuator on the key frame 13, the key frame 13 may be eliminated for directly mounting the actuator on the key bed 11.

According to this modification, since the electromagnetic plungers are disposed beneath the front ends of the keys and pins constituting the movable members are inserted through the perforations of the keys, and the upper ends of the pins are connected to the keys, it is possible to construct the solenoid actuator as a compact unit. As a consequence, it not necessary to form large spaces between the keys and the key frame for accommodating the solenoid actuators. In addition, no special machining is necessary for the key frame, thus making it possible to preserve its mechanical strength, and the keys are moved together with movable members.

What is claimed is:

1. Solenoid actuators for use in a keyboard instrument including a key bed, and a plurality of keys mounted on said key bed through seesaw mechanisms, wherein said actuators comprise a plurality of electromagnetic plungers, and said actuators are disposed between said key bed and said keys for independently actuating said keys, wherein the electromagnetic plungers for adjacent keys are displaced in the longitudinal directions of the keys so that the plungers as a whole are staggered and disposed between a single pair of integrally connected yoke members, which yoke members unite each of said plungers.

2. A solenoid actuator according to claim 1 wherein each one of said electromagnetic plungers comprises an annular exciting coil, a movable member movable in an opening of said exciting coil and a yoke member secured to said movable member.

3. A solenoid actuator according to claim 2 wherein each of said plungers comprises upper and lower hollow cylindrical plunger members which are normally spaced apart from each other, a pin extending through said upper and lower plunger members and an armature secured to said pin, the confronting end surfaces of said upper and lower plungers being formed with complementally frust conical surfaces to increase thrust forces when said exciting coil is energized.

4. A solenoid actuator according to claim 3 wherein a push member is provided for an upper end of said pin to push up each key when said exciting coil is energized.

5. A solenoid actuator according to claim 3 wherein each pin extends upwardly through each key and an upper end of said pin is adjustably connected to said key by a nut.

6. A solenoid actuator according to claim 3 wherein a coil spring is interposed between said pin and an inner wall of said upper plunger.

7. A solenoid actuator according to claim 3 wherein said armature is connected to a lower end of said pin and a cushion member is mounted on said armature.

8. A solenoid actuator according to claim 3 wherein a bushing is provided for an inner wall of said upper plunger to guide said pin.

9. A solenoid actuator according to claim 1 which further comprises one or more heat dissipating members provided between said upper and lower yoke members and extending in parallel therewith and a heat conductive compound filled in a space between said heat dissipating member and exciting coils of said electromagnetic plungers.

10. A solenoid actuator according to claim 9 wherein said heat dissipating member is in thermal contact with said yoke member.

* * * * *